United States Patent [19]

Hickman

[11] 4,357,732

[45] Nov. 9, 1982

[54] AUTOMATIC DOOR CLOSER KIT

[76] Inventor: David H. Hickman, 6514 E. 74th St., Tulsa, Okla. 74133

[21] Appl. No.: 102,144

[22] Filed: Dec. 10, 1979

[51] Int. Cl.[3] ..... E05F 1/00

[52] U.S. Cl. ..... 16/81

[58] Field of Search ..... 16/81

[56] References Cited

U.S. PATENT DOCUMENTS

| | | | |
|---|---|---|---|
| 2,551,032 | 5/1951 | McDonald | 16/81 |
| 4,003,102 | 1/1977 | Hawks et al. | 16/81 X |
| 4,126,912 | 11/1978 | Johnson | 16/81 |

FOREIGN PATENT DOCUMENTS

| | | | |
|---|---|---|---|
| 1038947 | 9/1958 | Fed. Rep. of Germany | 16/81 |

*Primary Examiner*—Wayne L. Shedd

*Attorney, Agent, or Firm*—William S. Dorman

[57] ABSTRACT

An automatic door closer kit for a sliding door assembly comprising a doorway frame having first and second vertical jambs which are horizontally spaced and an upper horizontal lintel connecting across the two jambs and having two downwardly extending parallel rails, wherein the doorway frame defines a vertical plane. A stationary panel is mounted within the plane adjacent the second jamb. A movable door, having an upper end, a lower end, first and second vertical sides, with the first side adjacent the first jamb when the movable door is closed, is received within the rails of the lintel and is slidably mounted within the plane of the doorway. The door closer kit is gravity actuated and comprises a counterbalance having an adjustable weight capacity, an anchor pulley mechanism having a grooved pulley wheel thereon and mounted on the lintel and one of the rails, a traveling pulley mechanism having a grooved pulley wheel thereon and mounted on the upper edge of the second side of the movable door, and a lifting pulley mechanism having a grooved pulley wheel thereon and mounted on an upper portion of the stationary panel adjacent the second jamb. A cord, having one end thereof attached to the counterbalance, is entrained over the lifting pulley then about the anchor pulley and about the traveling pulley and the other end thereof is secured to a hook on the anchor pulley mechanism.

3 Claims, 7 Drawing Figures

AUTOMATIC DOOR CLOSER KIT

BACKGROUND OF THE INVENTION

1. Field of the Invention

This invention relates to a self-contained kit for the closing of a sliding door and more particularly for the closing of a sliding glass door as found in homes or apartments. The invention is of a design to be readily attached to an existing door without disturbing or marring the existing installation.

2. Description of the Prior Art

Many devices for the self-closing of sliding doors are known in the prior art. Although most of these devices require complex installation, U.S. Pat. No. 4,126,912 (Johnson) is designed as a self-contained kit readily attachable to a pre-existing door. However, the Johnson patent requires the use of a counterbalance guide channel which has been eliminated in the present invention by two additional pulleys. The present device incorporates an adjustable counterbalance wherein much of the weight is supplied by the user. A lowering of shipping costs is gained by the use of the lightweight pulleys and the adjustable counterweight thereby lowering the total package cost to the consumer.

SUMMARY OF THE INVENTION

An object of the present invention is to provide for a self-closing mechanism for a sliding glass door assembly. The mechanism is provided by a self-contained kit that can be readily mounted upon a sliding door assembly without marring or disturbing the existing surfaces. Moreover, this invention offers a lower cost door closer than any of the prior art.

The automatic door closer kit is mounted upon a sliding door assembly comprised of a doorway frame having two jambs and a lintel. A glass panel is disposed within a metal frame that is stationary and mounted within the plane of the doorway frame. A movable door is slidably mounted within the plane of the doorway. The movable door consists of a glass panel disposed within the right and left stiles which interconnect to an upper and a lower leaf. A handle is affixed to the middle portion of the left stile.

The automatic door closer is gravity actuated and is comprised of a counterbalance with an adjustable weight capacity, three pulley mechanisms, a cord or cable and a disarming mechanism. The pulley mechanisms are each constructed of a molded one-piece nylon base, each base having an outwardly extending post that is an integral part of the base. The bases are affixed to the surface of the door assembly by means of double-faced adhesive tape. Grooved nylon pulley wheels are inserted through and snapped onto each post, thereby rotatably mounting each pulley on its respective post.

An L-shaped anchor pulley mechanism is affixed to the lower edge of the doorway lintel above the movable door. The post and the pulley wheel are positioned on the outside of the L. A metal hook is affixed to the lower right corner of the base of the anchor pulley mechanism.

Another L-shaped base, identified as the traveling pulley mechanism, is mounted on the upper edge of the right stile having its base and pulley wheel positioned on the outside of the L. A four-sided box configuration comprises the base of the lifting pulley mechanism, its post and pulley wheel positioned on the front side of the base. Adhesive tape is affixed to the remaining three sides and the base is mounted on the upper right corner of the stationary frame.

The base of the disarming mechanism is flat with its post positioned in the center. The base is mounted on the center of the lintel and affixed thereto by double sided adhesive foam tape.

The counterbalance is comprised of a hollow cylindrical body having a sealed bottom and preferably constructed of molded polyethylene. A molded eight-ounce lead weight is affixed inside the bottom of the cylinder. A cap is attached to the top of the cylinder by means of an attachment loop and the cap is made sealable by means of a snap lid. One end of the cord is attached to a wire handle affixed to the cap of the counterbalance. The cord is entrained over the lifting pulley, about the anchor pulley and then about the traveling pulley. The remaining end thereof is secured to the hook on the base of the anchor pulley mechanism.

DETAILED DESCRIPTION OF THE PREFERRED EMBODIMENTS

Figure 1:
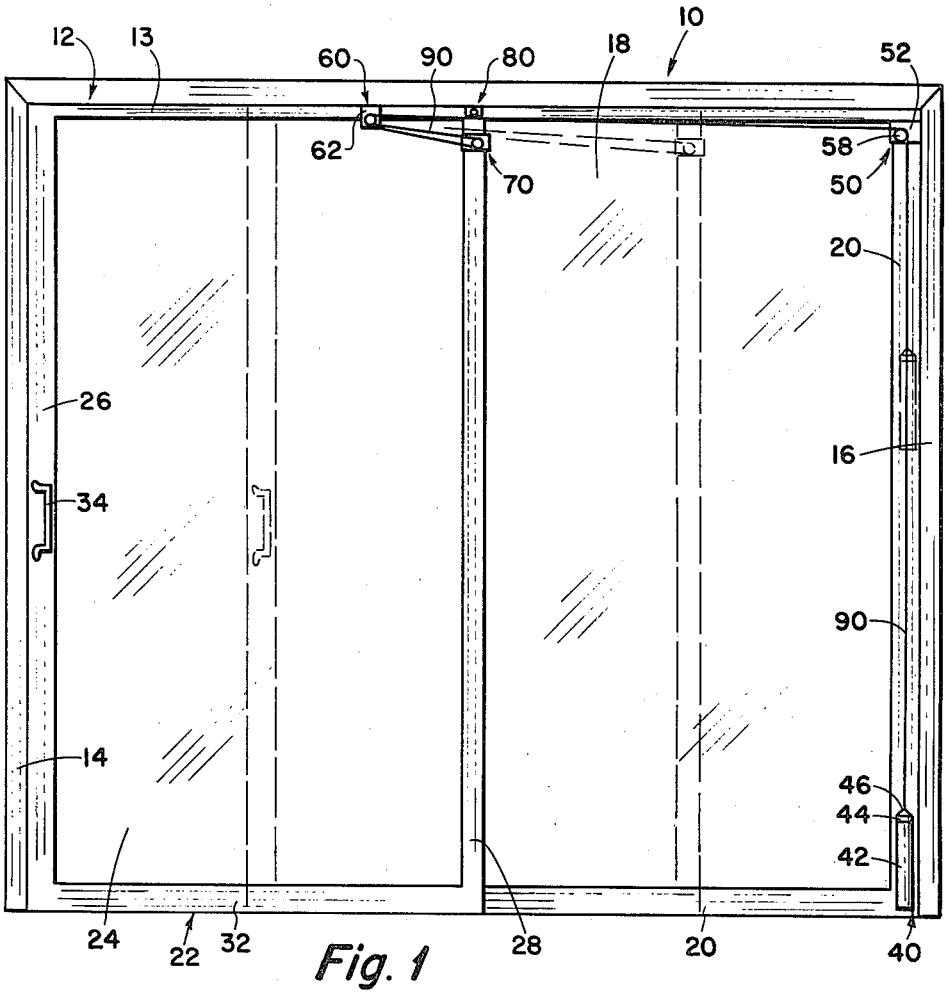
FIG. 1 illustrates a sliding door assembly having the present invention mounted thereon and showing an open position of the door in dotted lines.

The automatic door closer kit is employed to close a sliding door, such as a glass patio door left opened by a child. Referring to FIG. 1, the entire door assembly is shown with the door closer kit in place. A doorway frame 10 is comprised of a lintel 12 having two downwardly extending parallel rails 13 and a left vertical jamb 14 and a right vertical jamb 16. Doorway frame 10 defines a vertical plane. A glass panel 18 is disposed within a metal frame 20 adjacent jamb 16. Frame 20 is stationary and is mounted within the plane of doorway frame 10. A movable door 22 is slidably received within rails 13 of lintel 12. Movable door 22 is comprised of a glass panel 24 disposed within a left stile 26 and a right stile 28 which interconnect with an upper leaf 30 and a lower leaf 32. A handle 34 is affixed to the middle portion of stile 26 for ease of opening movable door 22.

The automatic door closer kit is gravity actuated and is comprised of a counterbalance 40 with an adjustable weight capacity, a lifting pulley mechanism 50, an anchor pulley mechanism 60, a traveling pulley mechanism 70, a disarming mechanism 80 and a cord or cable 90. Counterbalance 40 is comprised of a hollow cylinder 42, preferably molded polyethylene, with a sealed bottom. A molded eight-ounce lead weight (not shown) is affixed inside the bottom of cylinder 42. A cap 44 is attached to the top of cylinder 42 by an attachment loop (not shown). Cap 44 is made sealable onto cylinder 42 by means of a snap lid. A wire lifting handle 46 is affixed to cap 44.

Figure 3:
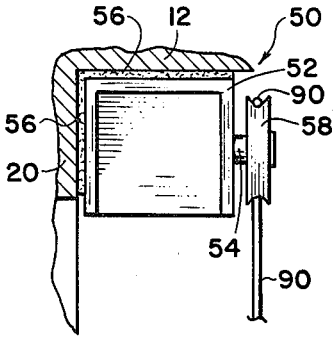
FIG. 3 is a section view taken along line 3—3 of FIG. 2.
Figure 2:
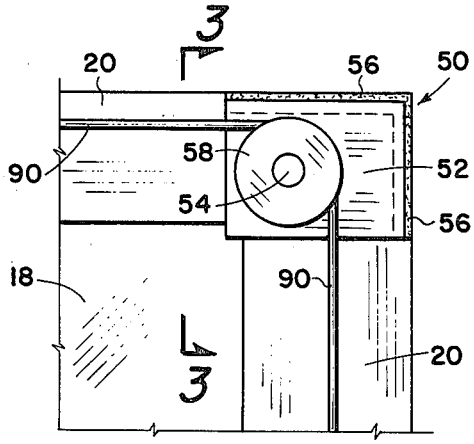
FIG. 2 is a view of the upper right-hand corner of FIG. 1, on an enlarged scale, and showing the details of a pulley mechanism.

Referring to FIGS. 2 and 3, lifting pulley mechanism 50 is shown mounted on the upper right corner of stationary frame 20. Lifting mechanism 50 is comprised of a one piece molded nylon base 52 which is provided with an outwardly extending post 54. Base 52 is shown as a four-sided box with double-faced adhesive foam tape 56 on three sides of the box. Thus, by means of this tape, the rear side of base 52 is affixed to frame 20, the top side is affixed to the lower edge of lintel 12 and the remaining taped side is affixed to the left edge of right jamb 16. A grooved nylon pulley wheel 58 is inserted through and snapped onto post 54, thereby rotatably mounting pulley 58 on post 54.

Figure 4:
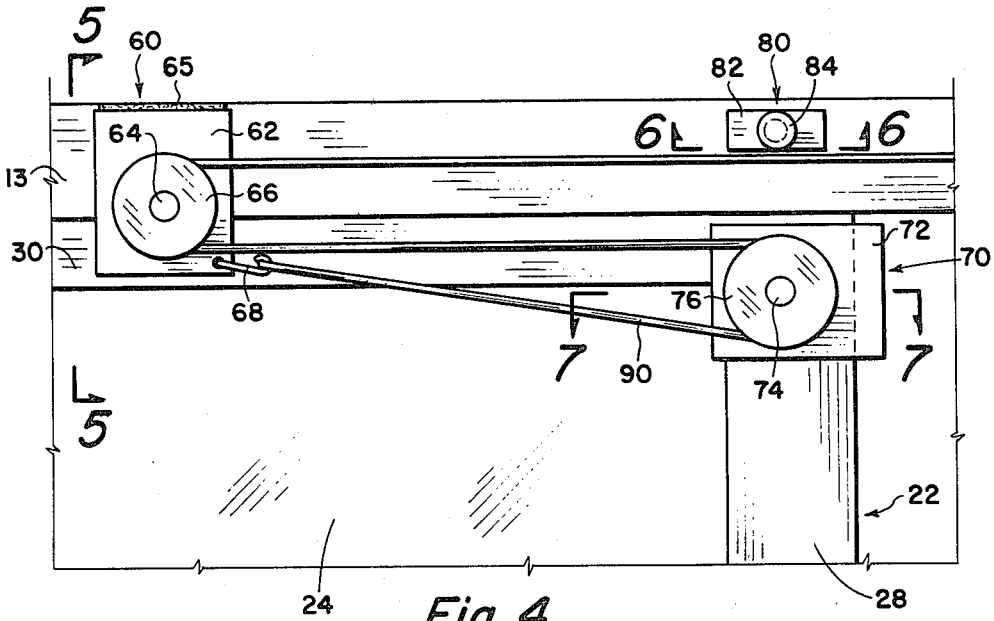
FIG. 4 is a view, on an enlarged scale, of the upper central portion of FIG. 1, showing the remaining pulley mechanisms and the disarming mechanism.

In FIG. 4, anchor pulley mechanism 60, traveling pulley mechanism 70 and disarming mechanism 80 are shown in their respective positions when door 22 is closed.

Figure 5:
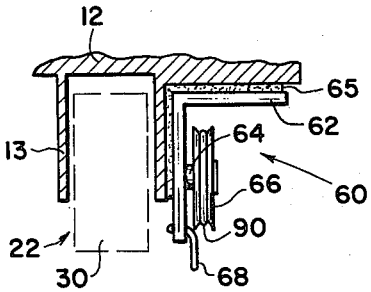
FIG. 5 is a section view taken along line 5—5 of FIG. 4.

Referring to FIGS. 4 and 5, anchor pulley mechanism 60 is comprised of an L-shaped nylon base 62 which is provided with an outwardly extending post 64 on the inside of the L. Adhesive foam tape 65 is affixed to the rear and top of base 62 and base 62 is mounted on the front of rail 13 and the lower edge of lintel 12 by means of tape 65. A pulley wheel 66, similar to aforementioned pulley 58, is rotatably mounted on post 64. The lower right corner is provided with a metal hook 68, the purpose of which will be described hereafter.

Figure 7:
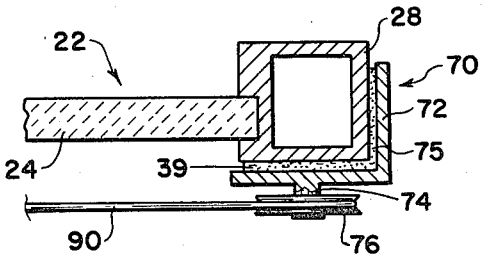
FIG. 7 is a section view taken along line 7—7 of FIG. 4.

Traveling pulley mechanism 70 is comprised of an L-shaped nylon base 72 which is provided with a post extending outwardly from base 72 on the outside surface of the L. Adhesive foam tape 75 is affixed to the two inside surfaces of base 72 and base 72 is mounted, by means of tape 75, on the edge of stile 28, as shown in FIG. 7.

Figure 6:
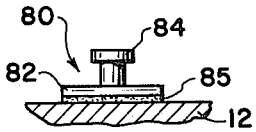
FIG. 6 is a section view taken along line 6—6 of FIG. 4.

As seen in FIG. 6, disarming mechanism 80 is comprised of a flat nylon base 82 provided with an outwardly extending post 84 in the center of base 82. Adhesive foam tape 85 is affixed to the back of base 82 so that base 82 is affixed to and mounted on lintel 12 above stile 28.

One end of cord 90 is attached to handle 46 of counterbalance 40. Cord 90 is entrained over lifting pulley 58, about anchor pulley 66 and about traveling pulley 76; the other end of cord 90 is secured to hook 68. Movable door 22 is opened by applying a manual force to handle 34 and sliding movable door 22 to the right. Traveling pulley mechanism 70 moves to the right with door 22, extending cord 90 between traveling pulley mechanism 70 and anchor pulley mechanism 60. This opening action causes counterbalance 40 to be lifted by cord 90 toward lifting pulley mechanism 50. When the opening force is removed from door 22, counterbalance 40 will exert a downward pressure on the right portion of cord 90 and subsequently exerts this downward force along the full length of cord 90. The gravity actuated force will move traveling pulley mechanism to the left thereby closing door 22.

The weight required to close door 22 varies according to its type of construction and other factors such as dust, weather and the conditions of door 22. The weight of counterbalance 22 can be adjusted by the addition of lead shot, sand or even ordinary table salt to cylinder 42. Cylinder 42, for example, can hold approximately 16.5 ounces of salt, giving a total weight of 22.5 ounces to counterbalance 40, which is sufficient to close a very heavy door. Door 22 can be returned to normal operation by removing the loop of cord 90 from traveling pulley 76 and placing it around post 84 of disarming mechanism 80.

What is claimed is:

1. An automatic door closer kit for a sliding door assembly comprising a doorway having first and second vertical jambs, said jambs being horizontally spaced, an upper horizontal lintel connecting across said jambs and having two downwardly extending parallel rails, said doorway frame defining a vertical plane, a stationary panel mounted within said plane adjacent said second jamb, a movable rectangular door having an upper leaf, a lower leaf, first and second vertical stiles with said first stile being adjacent said first jamb when said movable door is in a closed position, the upper leaf of said movable door being received within said rails of said lintel so that said door is slidably mounted within said plane of said doorway frame; said door closer kit being gravity actuated and comprising;

a counterbalance having an adjustable weight capacity, an anchor pulley mechanism including a first L-shaped base having a first outwardly extending post mounted on the inside of the L, a grooved anchor pulley wheel rotatably mounted on said first post, double-faced adhesive tape mounted on the outer surfaces of said first base for attachment of said first base to one of said rails and to said lintel, a traveling pulley mechanism including a second L-shaped base having a second outwardly extending post mounted on the outside of the L, a grooved traveling pulley wheel rotatably mounted on said second post, double-faced adhesive tape mounted on the inner surfaces of said second base for attachment of said second base to said second stile;

a lifting pulley mechanism including a third base in the form of a four-sided box, a third post extending outwardly from the outer side surface of one of the sides of said box, a grooved lifting pulley wheel rotatably mounted on said third post, double-faced adhesive tape mounted on the outer surfaces of the other three sides of said third base for attachment of said third base to said second jamb, to said lintel and to said frame, and a cord having one end thereof attached to said counterbalance, said cord being entrained over said lifting pulley then about said anchor pulley and about said traveling pulley, the other end of said cord being secured to said first base.

2. An automatic door closer kit as set forth in claim 1 wherein said counterbalance comprises a hollow cylinder having a sealed bottom, a weight affixed within said cylinder, and a sealable cap removably attached to the top of said cylinder wherein said cap is removed to place various materials within said cylinders for adjusting the weight of said counterbalance.

3. An automatic door closer kit as set forth in claim 1 including a disarming mechanism comprising a one piece nylon base, a center post being an integral part of said base wherein said door closer is disabled by removing the loop of said cord from about said traveling pulley and said loop being placed about said post of said disarming mechanism.

* * * * *